US007694658B2

(12) United States Patent
Ramella

(10) Patent No.: US 7,694,658 B2
(45) Date of Patent: Apr. 13, 2010

(54) TWO-STROKE ENGINE, ESPECIALLY FOR LANDCRAFT, WATERCRAFT, OR AIRCRAFT MODELS

(75) Inventor: Fabrice Ramella, Vufflens-la-Ville (CH)

(73) Assignee: Team Orion Europe SA, Plan-les-Quates (CH)

( * ) Notice: Subject to any disclaimer, the term of this patent is extended or adjusted under 35 U.S.C. 154(b) by 4 days.

(21) Appl. No.: 11/994,671

(22) PCT Filed: Jun. 22, 2006

(86) PCT No.: PCT/CH2006/000336

§ 371 (c)(1),
(2), (4) Date: Jun. 12, 2008

(87) PCT Pub. No.: WO2007/003064

PCT Pub. Date: Jan. 11, 2007

(65) Prior Publication Data

US 2009/0020107 A1 Jan. 22, 2009

(30) Foreign Application Priority Data

Jul. 6, 2005 (CH) ..... 1128/05

(51) Int. Cl.
*F02B 25/00* (2006.01)

(52) U.S. Cl. ..... 123/73 PP; 123/73 R; 123/193.2

(58) Field of Classification Search ..... 123/73 R, 123/73 PP, 193.2
See application file for complete search history.

(56) References Cited

U.S. PATENT DOCUMENTS

2006/0112924 A1 6/2006 Schaefer et al.

FOREIGN PATENT DOCUMENTS

| | | | | |
|---|---|---|---|---|
| DE | 4116652 | C1 | | 6/1992 |
| EP | 0059872 | A1 | | 9/1982 |
| FR | 2597924 | A1 | | 10/1987 |
| GB | 238933 | | | 8/1925 |
| JP | 57008333 | A | * | 1/1982 |
| JP | 57076364 | A | | 5/1982 |
| JP | 61028741 | A | | 2/1986 |
| JP | 63131848 | A | | 6/1988 |

* cited by examiner

*Primary Examiner*—Noah Kamen
(74) *Attorney, Agent, or Firm*—The Webb Law Firm

(57) ABSTRACT

Disclosed is a two-stroke engine, especially for landcraft, watercraft, or aircraft models, comprising a piston which can be moved up and down within a bush, defines a combination chamber at the top, and is connected to a crankshaft via a con-rod at the bottom, said crankshaft being rotatably mounted in a crank housing located below the bush. In order to reduce friction of the piston in the bush of such a two-stroke engine, the bottom end of the bush, which adjoins the crank housing is provided with means that increase the temperature-related radial expansion of the bush.

11 Claims, 2 Drawing Sheets

TWO-STROKE ENGINE, ESPECIALLY FOR LANDCRAFT, WATERCRAFT, OR AIRCRAFT MODELS

TECHNICAL FIELD

The present invention relates to the field of internal combustion engines. It concerns a two-stroke engine, especially for landcraft, watercraft or aircraft models. Such a two-stroke engine is known, for example from publication EP-A1-0 059 872.

PRIOR ART

Two-stroke engines for aircraft models (model engines) are usually designed as single-cylinder engines and have a piston which runs in a cylinder and which is connected via a connecting rod to a crankshaft rotatably mounted in a crankcase. The piston is pivotably mounted at the top end of the connecting rod by means of a piston pin. The connecting rod transmits the movement of the piston to a crankshaft. Via the hollow crankshaft, a fuel/air mixture is drawn into the crankcase, compressed and delivered via an overflow passage into the combustion chamber. Arranged opposite the overflow passage is an outlet, through which the combustion gases are forced outward. Inserted into the cylinder is a cylinder liner, which defines the combustion chamber and in which the piston is displaceably mounted. Such a two-stroke engine is disclosed in the publication (FIGS. 1, 5) mentioned at the beginning. The cylinder liner is provided there with the designation 30 and the cylinder with the designation 18.

The piston and the cylinder having the inserted cylinder liner, in which the piston runs, are subjected to the heat to a very high degree. During stoppage and when the engine is being started, the piston, the cylinder and the cylinder liner are still cold and the material has not expanded. The cylinder and the piston expand from the stoppage temperature up to the operating temperature. The operating temperature at the top, in the region of the combustion chamber, is higher than the operating temperature in the bottom region of the cylinder, of the cylinder liner and of the piston. The bottom region of the cylinder liner lies in the crankcase, at a distance from the combustion chamber, that is to say at a point which is not so hot.

The cylinder liner and the piston are as a rule made of different materials. As a rule, therefore, the materials do not have the same coefficient of thermal expansion.

In many performance engines, the cylinder having the cylinder liner has a smaller diameter at the top than at the bottom at stoppage temperature; it is therefore conical. At the operating temperature, the cylinder liner becomes much warmer at the top, in the region of the combustion chamber, than at the bottom, in the region of the crankcase. It therefore expands more at the top than at the bottom. The cylinder liner then becomes virtually cylindrical, i.e. it has the same diameter at the top and bottom.

The conical shape of the cylinder liner has the disadvantage that the piston sticks at the top at stoppage temperature. This makes the starting of the engine more difficult. Every time the engine is started, the high friction causes undesirable wear of the piston and of the cylinder liner at the point at which the piston sticks. If the parts are worn, the piston and cylinder liner no longer form a seal. This makes the starting of the engine very difficult.

If the conicity of the cylinder liner is smaller than normal, the friction of the hot piston during every downward movement of the piston increases at the bottom cylinder liner wall, which is not so hot. The engine is then decelerated as a result. Cylinder liners having two-stage conicity have also already been used, but these cylinder liners have a very complicated design and are very expensive to produce.

SUMMARY OF THE INVENTION

Disclosed is a two-stroke engine which is distinguished by a marked reduction in the thermally induced friction between piston and cylinder liner wall.

The cylinder liner, at the bottom end adjacent to the crankcase, has means which intensify the thermally induced radial expansion of the cylinder liner. As a result, the unequal expansion of the cylinder liner at the hot top end and at the comparatively cold bottom end can at least partly be compensated for.

The cylinder liner can have, at the bottom end, at least one slot running in the axial direction.

The cylinder liner can have, distributed over the circumference, a plurality of slots running in the axial direction, and, in particular, four slots arranged offset in each case by 90°.

In addition, the cylinder liner, in the region of the slots, may be provided with a respective bevel in such a way that the wall thickness of the cylinder liner is reduced toward the bottom.

The cylinder liner can narrow slightly conically toward the top.

BRIEF EXPLANATION OF THE FIGURES

The invention is to be explained in more detail below with reference to exemplary embodiments in connection with the drawing, in which.

WAYS OF IMPLEMENTING THE INVENTION

Figure 1:
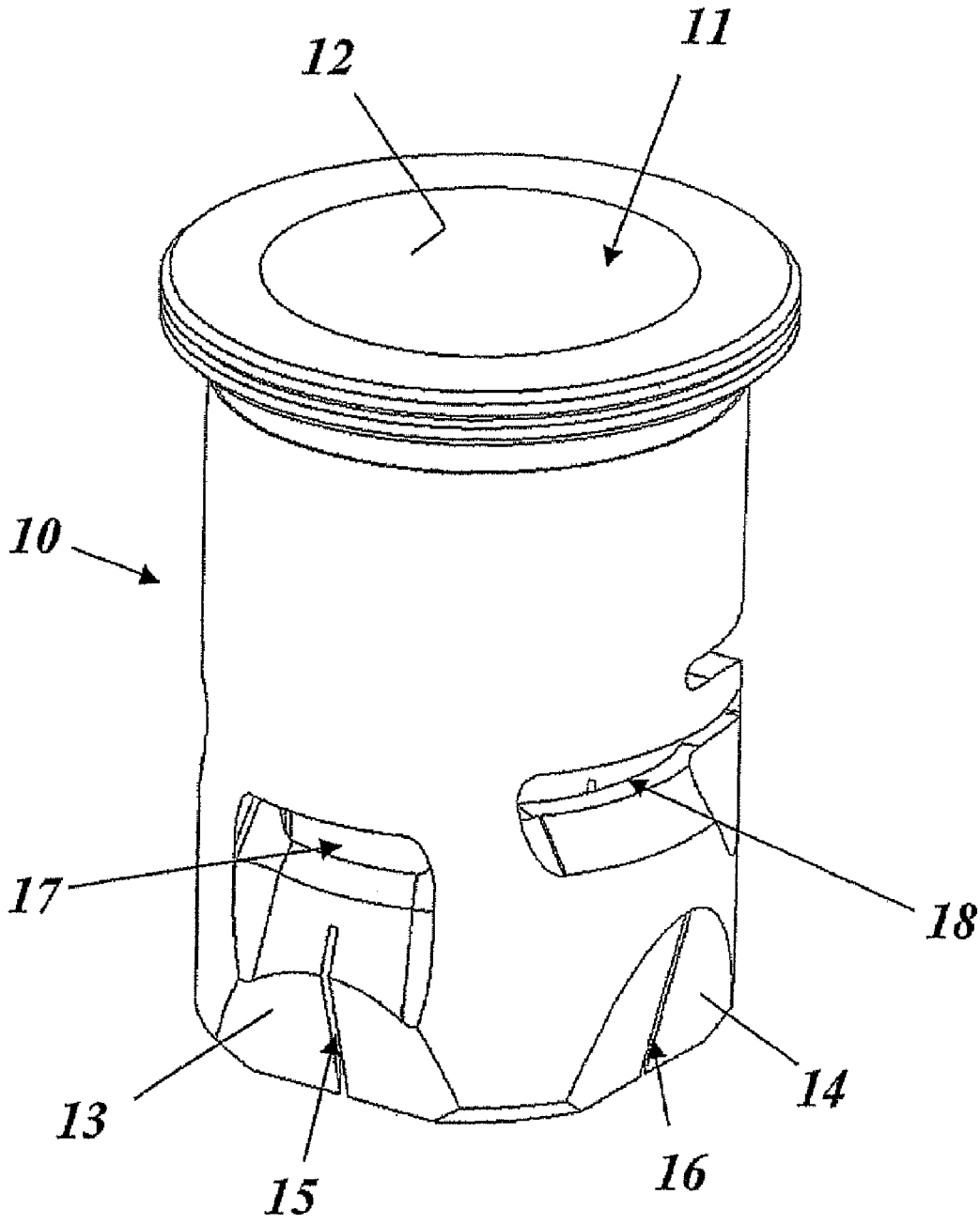
FIG. 1 shows, in a perspective side view, an exemplary embodiment of a cylinder liner according to the invention, having four slots in beveled surfaces at the bottom margin of the cylinder liner.
Figure 2:
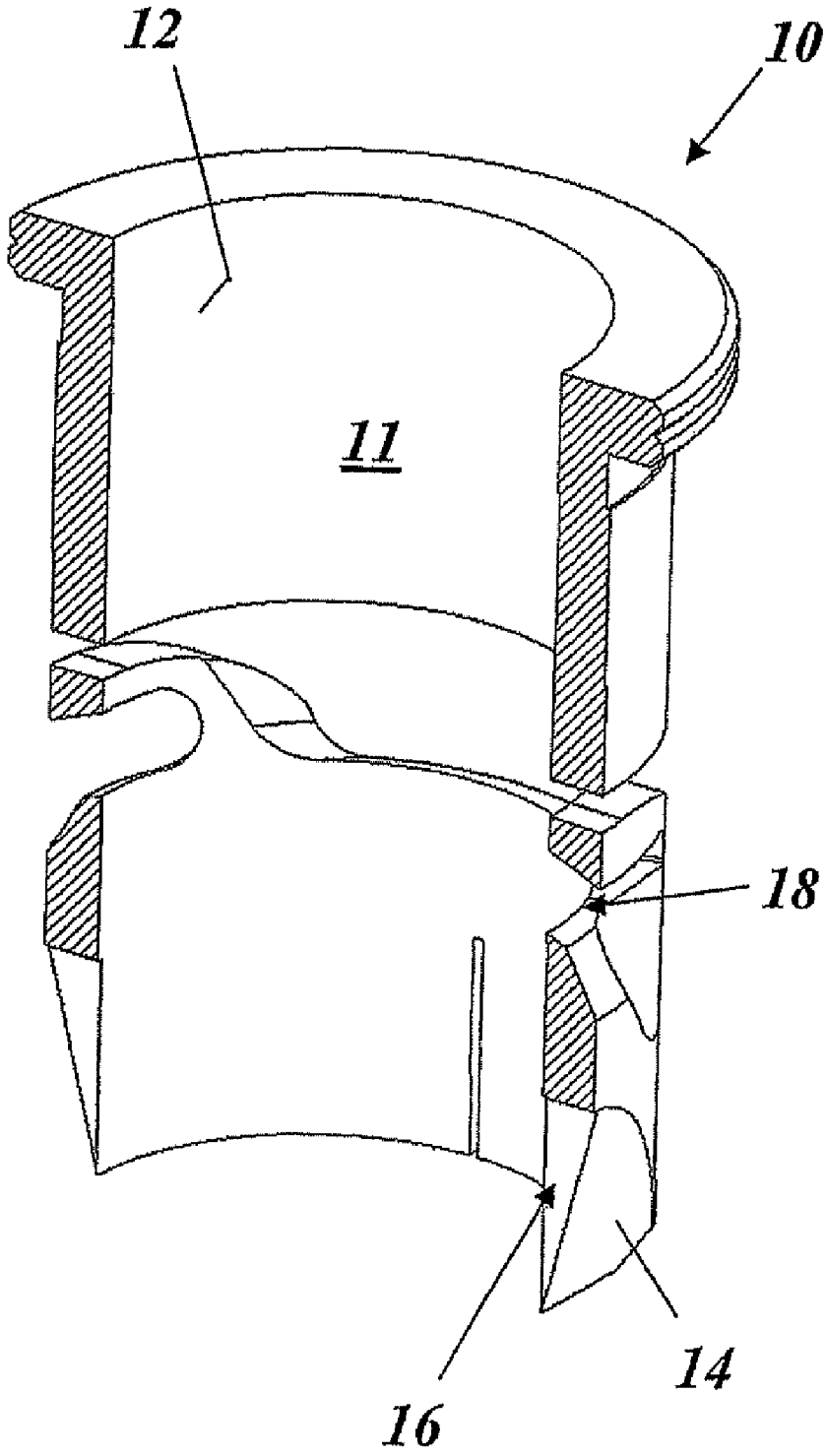
FIG. 2 shows the cylinder liner from FIG. 1 in a perspective sectional view.

A cylinder liner for a two-stroke engine according to a preferred exemplary embodiment of the invention is reproduced in FIGS. 1 and 2. The cylinder liner 10 has an essentially circular-cylindrical shape, but may taper slightly conically towards the top. The cylinder liner is inserted into a cylinder, as shown by way of example in the publication mentioned at the beginning. The cylinder liner 10 has a plurality of openings 17, 18 which are arranged at the circumference in a distributed manner and serve to feed the fresh gas and to discharge the combustion gases.

The cylinder liner 10 encloses a cylinder space 11 in which the piston (not shown) is mounted in a sliding, displaceable manner. The piston slides along the cylinder liner wall 12 in the process. Depending on the temperature (stoppage temperature or operating temperature), the piston and the cylinder liner 10 expand differently. In addition, temperature differences arise between the (hotter) top part of the cylinder liner 10 and the (colder) bottom part.

The novel cylinder liner is cut open at the bottom at least once in the axial direction, such that the bottom cylinder liner part can fan out in a petaled manner. In the example of FIGS. 1 and 2, four slots 15, 16 are arranged at the circumference in a distributed manner, said slots 15, 16 being offset in each case by 90°. Of the four slots, only two front slots can be seen. The narrow slots 15, 16 end below the openings 17, 18.

The expansion of the bottom parts of the cylinder liner 10 is influenced by the temperature. It should be noted in particular that the inner bottom hotter part of the cylinder liner 10 is hotter than the outer bottom part of the cylinder liner. On the inside, friction, inter alia, occurs due to the piston and due to heating by the hot combustion gases. On the outside, the cylinder liner parts are cooled by the colder and cooling engine housing, by the cold fresh gas mixture, etc. The result is outward deformation of the bottom cylinder liner parts.

With this cylinder embodiment, the conicity of the cylinder liner 10 can be kept small, the seal between piston and cylinder is improved, the friction is reduced, the sticking in the top part is removed or at least reduced, and the wear is reduced. The starting of the engine is facilitated. The engine gains in power and in acceleration response. In addition, the cylinder liner 10 may be provided with milled bevels 13, 14 in the region of the slots in order to intensify the expansion effect.

LIST OF DESIGNATIONS

10 Cylinder liner
11 Cylinder space
12 Cylinder liner wall
13, 14 Bevel
15, 16 Slot
17, 18 Opening

The invention claimed is:

1. A two-stroke engine comprising:

a piston and a cylinder liner, wherein the piston is moveable up and down in the cylinder liner;

a combustion chamber which is defined by the top end of the piston;

a connecting rod and a crankshaft, wherein the connecting rod connects said piston with the crankshaft at the bottom end of said piston; and a crankcase being arranged below the cylinder liner, wherein in the crankcase said crankshaft is rotatably mounted, wherein the cylinder liner comprises at least one slot which is arranged in the cylinder liner at the bottom end and which at least one slot runs in an axial direction, wherein said at least one slot intensifies the thermally induced radial expansion of the cylinder liner, wherein the slot comprises a length in the axial direction which is larger than the width of the slot in a tangential direction.

2. The two-stroke engine as claimed in claim 1, wherein the cylinder liner has, distributed over the circumference, a plurality of slots running in axial direction.

3. The two-stroke engine as claimed in claim 1, wherein the cylinder liner has four slots arranged offset in each case by 90°.

4. The two-stroke engine as claimed in claim 1, wherein the cylinder liner, in the region of the slots, is provided with a respective bevel in such a way that the wall thickness of the cylinder liner is reduced toward the bottom.

5. The two-stroke engine as claimed in claim 1, wherein the cylinder liner narrows slightly conically toward the top.

6. A two-stroke engine comprising:

a piston and a cylinder liner, wherein the piston is moveable up and down in the cylinder liner;

a combustion chamber which is defined by the top end of the piston;

a connecting rod and a crankshaft, wherein the connecting rod connects said piston with the crankshaft at the bottom end of said piston; and a crankcase being arranged below the cylinder liner, wherein in the crankcase said crankshaft is rotatably mounted, wherein the cylinder liner comprises at least one slot which is arranged in the cylinder liner at the bottom end and which at least one slot runs in an axial direction, wherein said at least one slot intensifies the thermally induced radial expansion of the cylinder liner, wherein the cylinder liner has four slots arranged offset in each case by 90°.

7. The two-stroke engine as claimed in claim 6, wherein the cylinder liner, in the region of the slots, is provided with a respective bevel in such a way that the wall thickness of the cylinder liner is reduced toward the bottom.

8. The two-stroke engine as claimed in claim 6, wherein the cylinder liner narrows slightly conically toward the top.

9. A two-stroke engine comprising:

a piston and a cylinder liner, wherein the piston is moveable up and down in the cylinder liner;

a combustion chamber which is defined by the top end of the piston;

a connecting rod and a crankshaft, wherein the connecting rod connects said piston with the crankshaft at the bottom end of said piston; and a crankcase being arranged below the cylinder liner, wherein in the crankcase said crankshaft is rotatably mounted, wherein the cylinder liner comprises at least one slot which is arranged in the cylinder liner at the bottom end and which at least one slot runs in an axial direction, wherein said at least one slot intensifies the thermally induced radial expansion of the cylinder liner, wherein the cylinder liner, in the region of the slots, is provided with a respective bevel in such a way that the wall thickness of the cylinder liner is reduced toward the bottom.

10. The two-stroke engine as claimed in claim 9, wherein the cylinder liner narrows slightly conically toward the top.

11. The two-stroke engine as claimed in claim 9, wherein the cylinder liner has, distributed over the circumference, a plurality of slots running in axial direction.

* * * * *

UNITED STATES PATENT AND TRADEMARK OFFICE

CERTIFICATE OF CORRECTION

PATENT NO. : 7,694,658 B2
APPLICATION NO. : 11/994671
DATED : April 13, 2010
INVENTOR(S) : Ramella It is certified that error appears in the above-identified patent and that said Letters Patent is hereby corrected as shown below:

Face of the Patent, see Item (73) Assignee: Line 2, "Plan-les-Quates (CH)"
should read -- Plan-les-Ouates (CH) --

Signed and Sealed this

Twenty-fourth Day of August, 2010

David J. Kappos

David J. Kappos
*Director of the United States Patent and Trademark Office*